US005794922A

United States Patent [19]

Meglino et al.

[11] Patent Number: 5,794,922

[45] Date of Patent: Aug. 18, 1998

[54] FENCE SLATS WITH LOCKING PORTIONS

[76] Inventors: Don A. Meglino; James V. Meglino, both of 100 Frank Rd., Hicksville, N.Y. 11802

[21] Appl. No.: 800,039

[22] Filed: Feb. 14, 1997

Related U.S. Application Data

[63] Continuation-in-part of Ser. No. 766,287, Dec. 13, 1996.

[51] Int. Cl.[6] ..... E04H 17/00

[52] U.S. Cl. ..... 256/34; 256/32

[58] Field of Search ..... 256/34, 35, 32, 256/24, 1, 21, 22, 19

[56] References Cited

U.S. PATENT DOCUMENTS

| | | | |
|---|---|---|---|
| 3,958,794 | 5/1976 | Suprunuk et al. | 256/34 |
| 4,512,556 | 4/1985 | Meglino | 256/34 |
| 4,723,761 | 2/1988 | Cluff | 256/34 |
| 4,725,044 | 2/1988 | Cluff | 256/34 |
| 4,950,098 | 8/1990 | Abbott et al. | 256/34 X |
| 5,234,199 | 8/1993 | Cluff | 256/34 |
| 5,275,380 | 1/1994 | Barsby | 256/34 |
| 5,395,092 | 3/1995 | McLaughlan et al. | 256/34 |
| 5,458,319 | 10/1995 | Mackay | 256/34 |
| 5,620,277 | 4/1997 | Cole, Sr. et al. | 256/1 X |
| 5,651,533 | 7/1997 | Ling | 256/34 |

*Primary Examiner*—Harry C. Kim
*Attorney, Agent, or Firm*—Galgano & Burke

[57] ABSTRACT

A two-piece fence slat for chain link fences and assemblies in which the fence slat comprises a hollow elongated body and an insertable locking member. The elongated body has a sidewall with at least one aperture extending therethrough. The insertable locking member is receivable in the elongated body and includes at least one stop dimensioned to extend through the aperture. Another embodiment comprises a hollow body member with at least one, integrally formed stop.

19 Claims, 10 Drawing Sheets

FENCE SLATS WITH LOCKING PORTIONS

This application is a continuation-in-part of U.S. patent application Ser. No. 08/766,287, filed Dec. 13, 1996.

The present invention is directed to fence slats for chain link fences and, more particularly, to fence slats comprising an integrally formed elongated body having stops extending outwardly from the elongated body, and to fence slats comprising a hollow elongated body and an insertable locking member having stops which when inserted into the hollow elongated body extend outwardly from the elongated body.

BACKGROUND OF THE INVENTION

Chain link fences have been widely used for many years to satisfy fencing requirements. While they provide acceptable strength and durability over many years, they do not provide privacy or serve as a windbreak due to their apertured construction. Various inserts, typically referred to as "slats", have been suggested and manufactured for increasing the privacy of a chain link fence, as well as serving as a windbreak. Many early arrangements were designed to be directly connected to the link of the fence and required clamping or bending of a metal slat onto a link of the fence.

One of the inventors of the present invention overcame a problem with slats migrating upwardly and downwardly due to wind or other environmental forces which creates an unfinished uneven appearance, by providing a slat retaining means which extended through a slot in the slats and which is further described in U.S. Pat. No. 4,512,556 to Meglino, issued on Apr. 23, 1985. Other attempts to maintain the slats properly disposed in the chain link fence include a separate bottom member which attaches to the bottom of the slats. A drawback with these slats is that they require a cross-member which increases the overall cost of the fence and the time required for installation.

Other attempts to maintain the slats properly within a chain link fence include U.S. Pat. No. 5,458,319 to Mackay which discloses a retainer device which is inserted in a groove in a slat and attaches to a link of a fence, and U.S. Pat. No. 5,275,380 to Barsby which discloses a corrugated slat having a raised, rounded retaining tab with a groove to engage a fence link in a snap-fit manner. There are drawbacks with the slats disclosed in Mackay and Barsby. The slat disclosed in Mackay requires a separate element which increases the slat cost and the time for installation. The slat disclosed by Barsby is easily removed from a fence and, therefore, is subject to vandalism.

There is, therefore, a need for a fence slat which overcomes the drawbacks of the prior art by providing fence slats which readily lock in a channel of a chain link fence and which inhibit the removal, particularly by vandals after installation.

SUMMARY OF THE INVENTION

The various embodiments of the present invention provide privacy fence slats for chain link fences and fence systems in which the fence slats are readily insertable in a chain link fence and once fully inserted in a channel of a chain link fence are inhibited from being removed.

One embodiment of the present invention provides fence slats comprising an integrally formed elongated body comprising a first side comprising a first outwardly extending stop and a second outwardly extending stop. The stops are spaced from each other and define a passageway therebetween, wherein when the slat is received in a channel of a chain link, a portion of a link is positionable in the passageway to prevent the slat from being removed.

In one preferred embodiment, a fence slat comprises an elongated body having a first side with first and second outwardly extending stops, and a second side with third and fourth outwardly extending stops. The stops on one side urge the stops on the opposite side around a link. The stops on one side may be either aligned or not aligned with the stops on the other side.

In another preferred embodiment, one of the stops has a tapered surface relative to the first surface of the slat to facilitate the insertion of the slat in a channel of a chain link fence. In another embodiment the stops are configured as a pair of raised circular-shaped tabs. Desirably, the pair of stops are disposed on both sides of the slat and are in alignment with each other so that the slats are reversible.

In still another preferred embodiment of the present invention, a fence slat comprises a stop on one side which, depending on the stops position, inhibits the slat from moving either up or down. In another embodiment, a fence slat comprises a stop on one side and a stop on an opposite side in which the stops may either be aligned or not aligned.

Yet another embodiment of the present invention provides fence slats comprising a hollow elongated body having at least one aperture extending therethrough, and an insertable locking member receivable in the elongated body in a snap-fit manner. The insertable locking member comprises at least one outwardly extending stop dimensioned to be alignable with the aperture in the elongated body.

According to another embodiment, a hollow body is provided with a plurality of apertures and a plurality of stops are spaced from each other and define a passageway therebetween, wherein when the slat is received in a channel of a chain link fence, a portion of a link is positionable in the passageway to prevent the slat from being removed.

DETAILED DESCRIPTION

Figure 1:
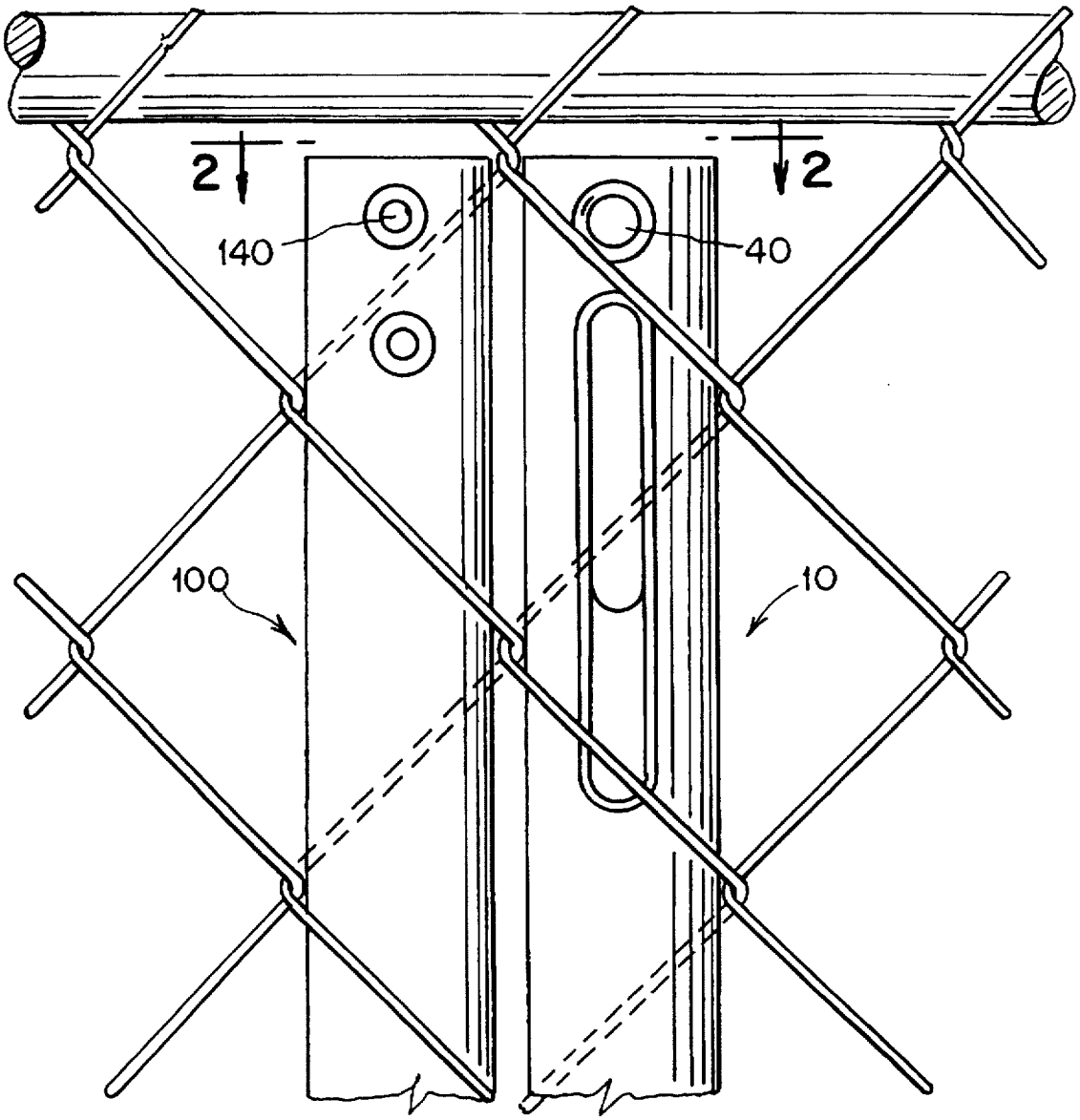
FIG. 1 is a front elevational view of two embodiments of fence slats of the present invention.
Figure 2:
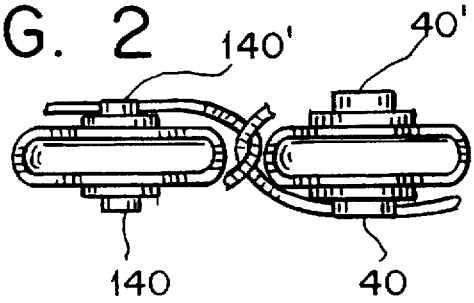
FIG. 2 is an end view of the two fence slats shown in FIG. 1 taken along line 2—2.

Turning now to the drawings and in particular to FIGS. 1 and 2, therein illustrated are two embodiments of fence slats according to the present invention. In particular, the illustrated fence assembly shows fence slat 10 and fence slat 100 inserted in adjacent channels of a chain link fence and once received therein are inhibited from being readily removed. As best shown in FIG. 2, stops 40 and 40' of fence slat 10 and stops 140 and 140' of fence slat 100 are configured to prevent the respective slat from being removed without bending the fence. Desirably, stops 40 and 40', and 140 and 140' provide a generally vertically disposed abutment face which inhibits removal of fence slats 10 and 100, particularly by vandals, once installed in a chain link fence.

Figure 3:
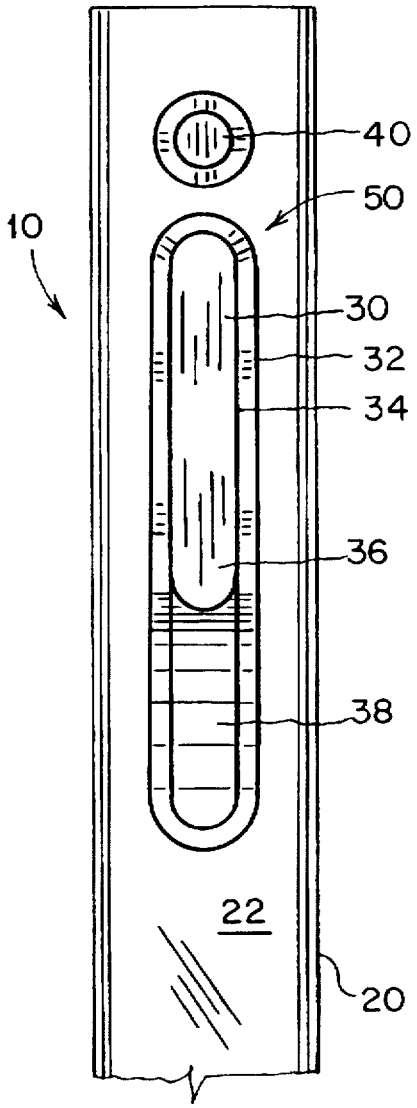
FIG. 3 is a front elevational view of one of the fence slats shown in FIG. 1.
Figure 4:
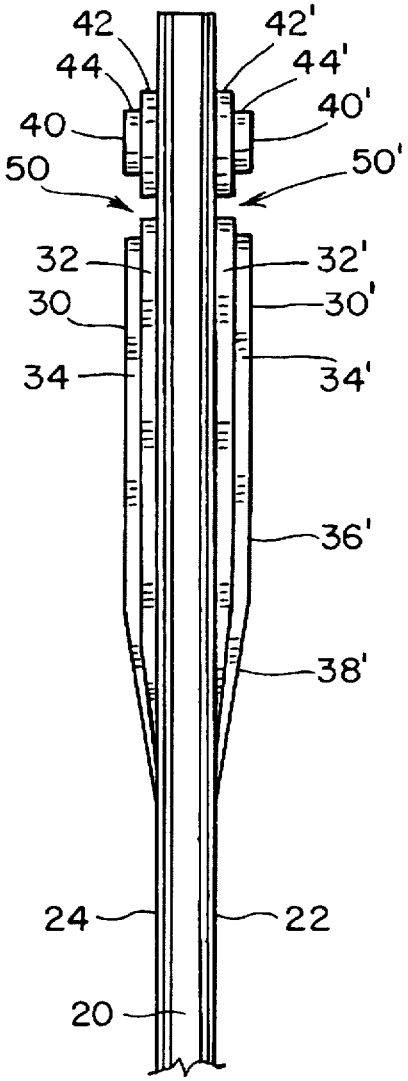
FIG. 4 is a side elevational view of the fence slat shown in FIG. 3.
Figure 5:
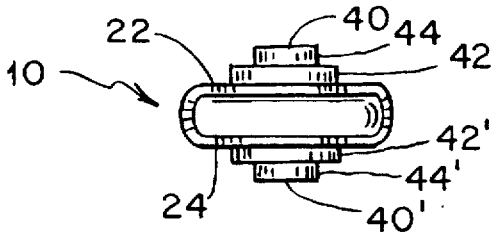
FIG. 5 is an end view of the fence slat shown in FIG. 3.

As shown in FIGS. 3–5, fence slat 10 comprises an elongated body 20 comprising a first side 22 with a first outwardly extending stop 30 and a second outwardly extending stop 40. Outwardly extending stops 30 and 40 are spaced from each other and define a passageway 50 therebetween and in which is received a portion of a link of a chain link fence (FIG. 1).

In this illustrated embodiment, stop 30 comprises a base portion 32 upon which is disposed an outer portion 34. Desirably, stop 30 is elongated, disposed longitudinally along surface 22 of the slat, and comprises a generally flat surface portion 36 and a tapered surface portion 38 to readily allow slat 10 to be inserted into a channel of a chain link fence. From the present invention, those skilled in the art will appreciate that the taper of surface 38 will facilitate the downward insertion of the slat into a fence channel.

Illustrated stop 40 is advantageously spaced from stop 30 and comprises a generally circular base 42 and a circular tab 44. Desirably, passageway 50 has a depth sufficient to receive the full diameter of a link in a chain link fence.

Advantageously, fence slat 10 is sized so as to extend between the knuckles of a chain link fence when inserted therein, and is hollow to be economically fabricated (FIG. 5). From the present description, it will be appreciated to those skilled in the art that for fence slats having a hollow configuration, base portions 32 and 42 of respective stops 30 and 40 increases the structural integrity and rigidity of the stops and better maintains the position of the stops about a link of a chain link fence when the slat is inserted therein.

Desirably, fence slat 10 comprises a pair of stops 30' and 40' disposed on the opposite side of slat 10 in alignment with respective stops 30 and 40 so that slat 10 is reversibly positionable in a channel of a chain link fence. Moreover, by positioning stop 30 on both sides of slat 10, the rearward stop 301 will urge the slat 10 forwardly and help to maintain the link of the fence securely between the stops on the front face of slat 10. This advantageous aspect of the present invention is clearly illustrated in FIG. 1.

Fence 100 illustrates alternative embodiment of the present invention in which fence slat 100 comprises an elongated body 120 comprising a pair of spaced generally circular raised stops 130 and 140 disposed on a surface 122 of elongated slat 120. Desirably, a second pair of stops 130' and 140' extend outwardly from the opposite side of elongated slat 120 and aligned with stops 130 and 140, respectively so that fence slat 100 can be reversibly inserted and maintained in a channel of a chain link fence. As in fence slat 10, stops 130 and 140 define a passageway 150 which retains fence slat 110 in a channel of a chain link fence once inserted.

Figure 15:
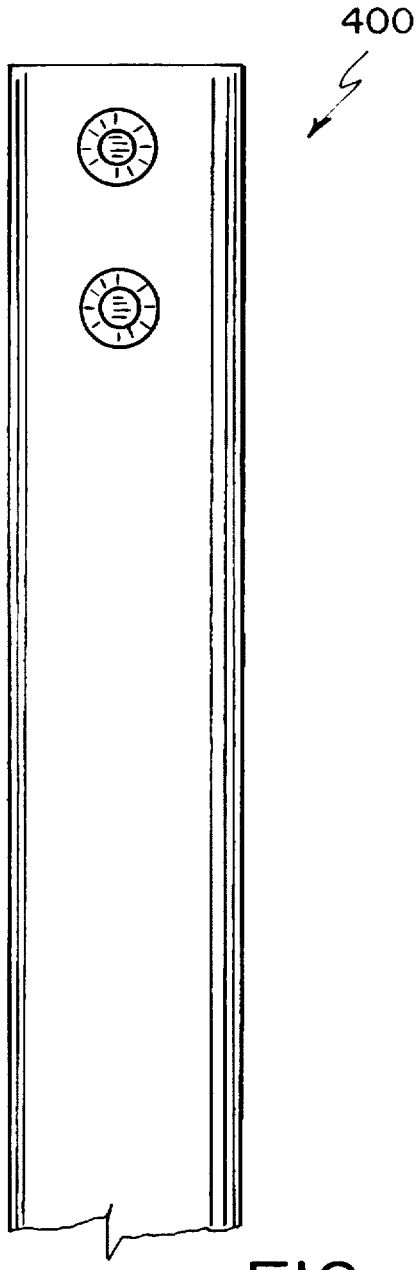
FIGS. 15–17 are a front elevational view, a side elevational view, and an end view, respectively, of another embodiment of the present invention.
Figure 16:
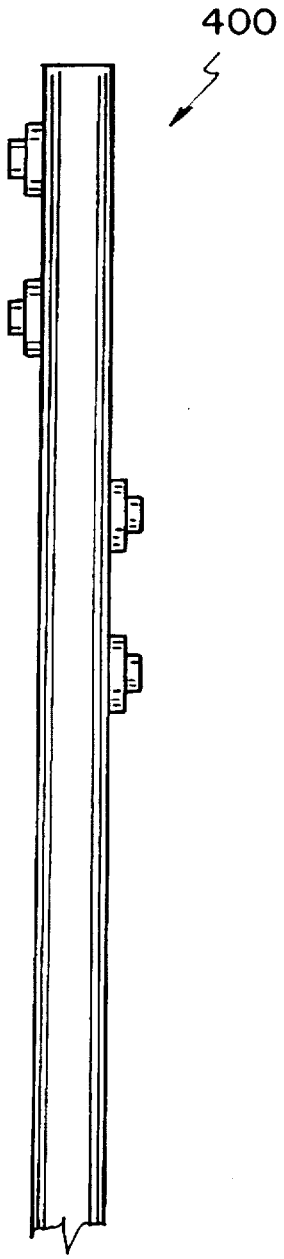
Figure 17:
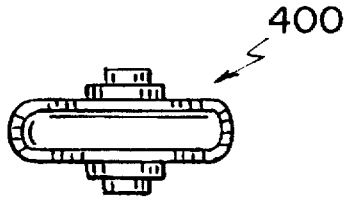
Figure 21:
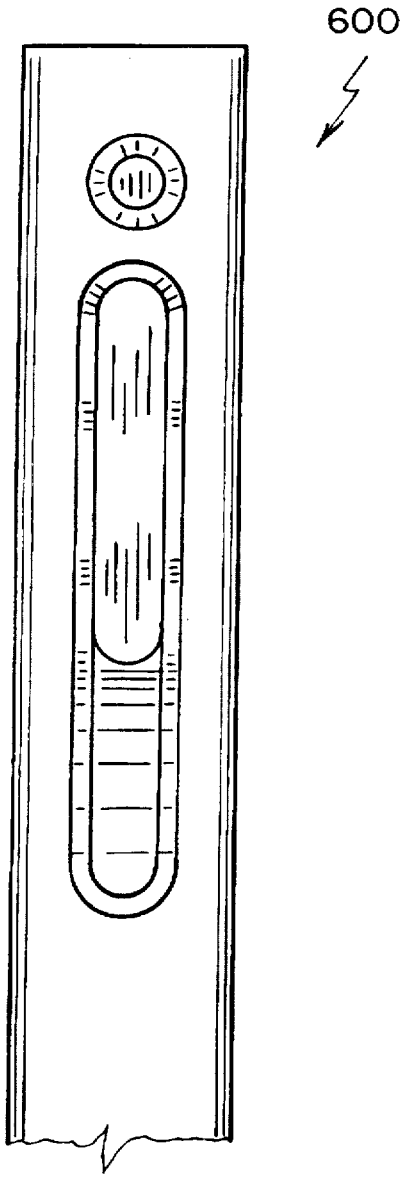
FIGS. 21–23 are a front elevational view, a side elevational view, and an end view, respectively, of another embodiment of the present invention.
Figure 22:
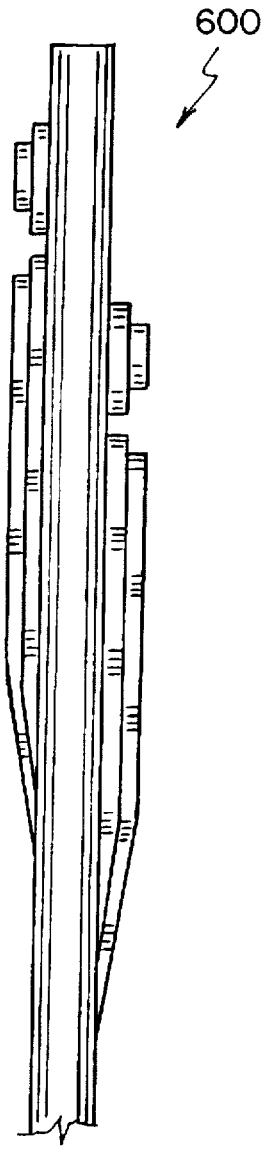
Figure 23:
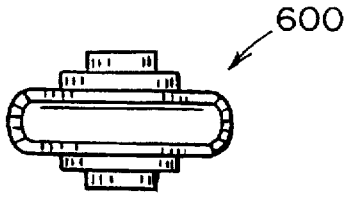

According to another embodiment of the present invention, single stops or pairs of stops are not aligned, but are offset so that a forward stop(s) engages a link on the forward surface of the slat while a rearward stop or pair of stops engages a link at an offset position on the rearward side of the slat, e.g., illustrated fence slat 400 in FIGS. 15–17, and illustrated fence slat 600 in FIGS. 21–23.

Figure 9:
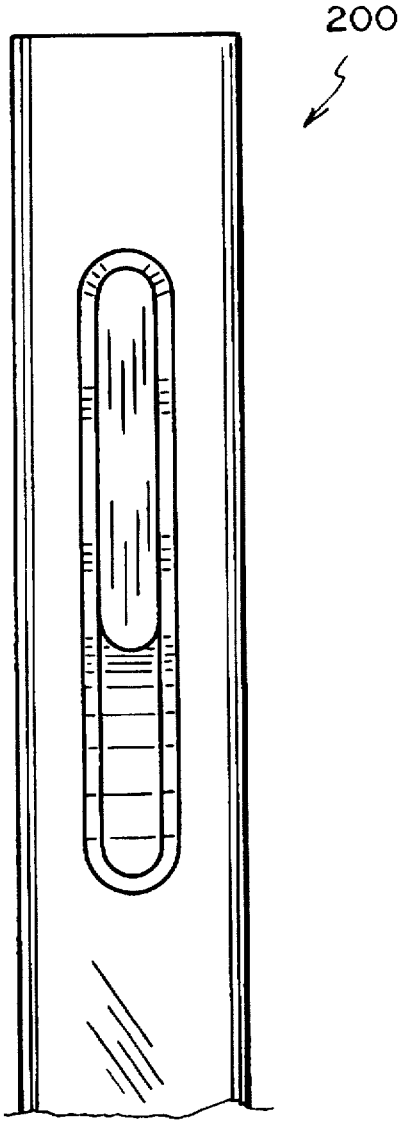
FIGS. 9–11 are a front elevational view, a side elevational view, and an end view, respectively, of another embodiment of the present invention.
Figure 10:
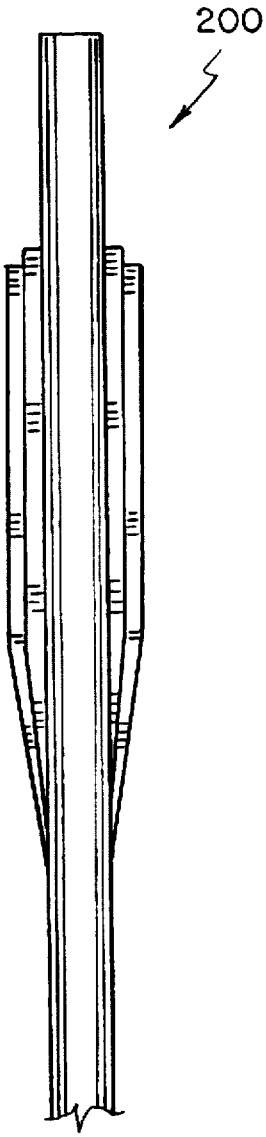
Figure 11:
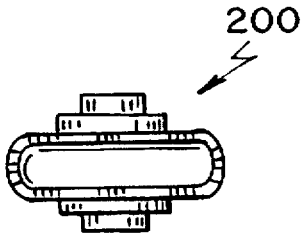
Figure 12:
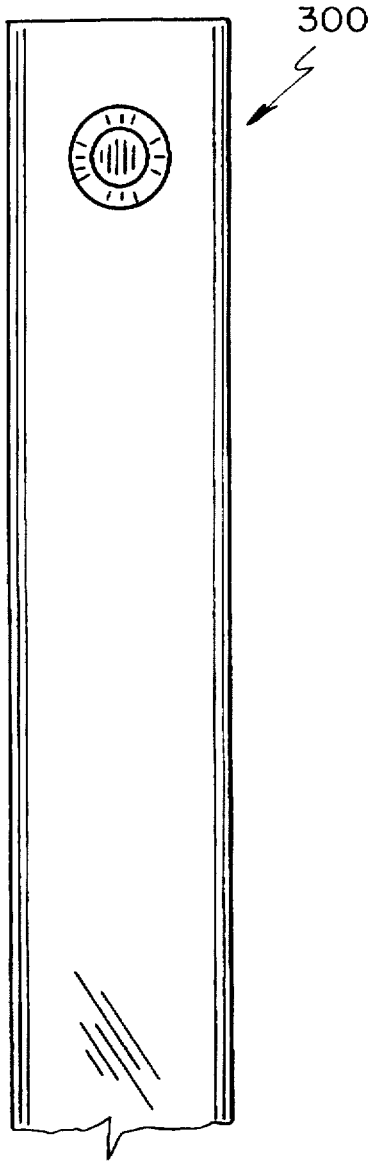
FIGS. 12–14 are a front elevational view, a side elevational view, and an end view respectively, of another embodiment of the present invention.
Figure 13:
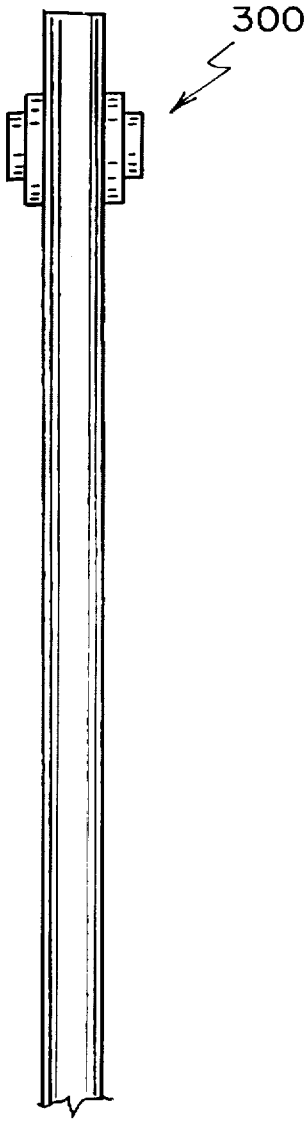
Figure 14:
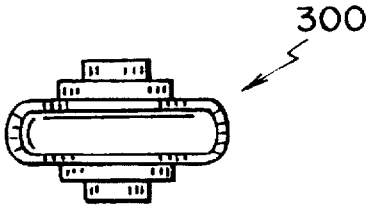

While the illustrated slats comprise two stops on each side, another preferred embodiment comprises only one stop on at least one side of the slat. This stop can advantageously prevent the slat from sliding downwardly when subject to normal environmental vibrations, e.g., illustrated fence slat 300 in FIGS. 12–14. Alternatively, depending upon how the slat is positioned relative to the fence, the stop can inhibit removal of the slat from a fence, e.g., illustrated fence slat 200 in FIGS. 9–11.

Figure 18:
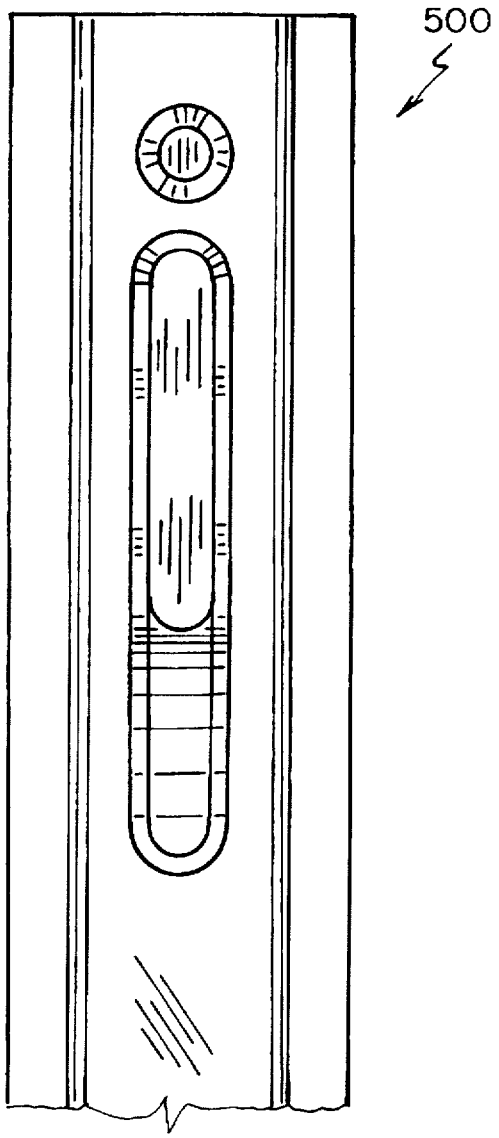
FIGS. 18–20 are a front elevational view, a side elevational view, and an end view, respectively, of another embodiment of the present invention.
Figure 19:
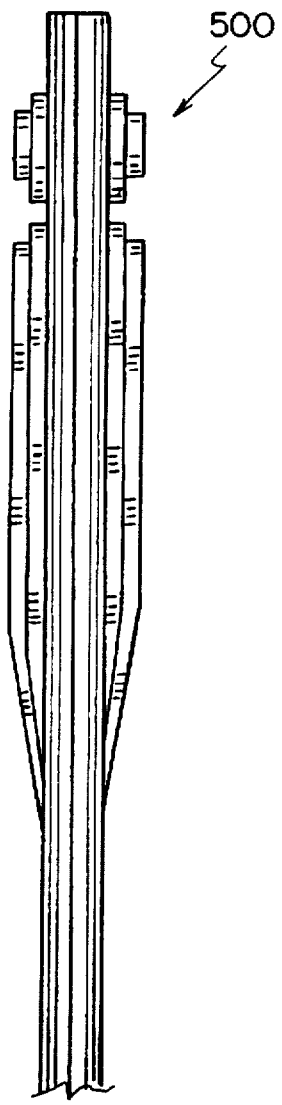
Figure 20:
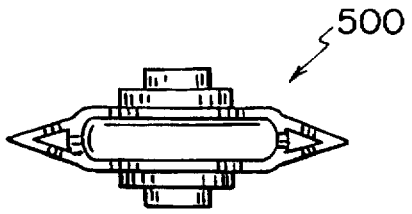

Those skilled in the art will also appreciate that the advantages of the present invention can be utilized with slats comprising wing portions which extend generally laterally, e.g., illustrated fence slat 500 in FIGS. 18–20. Furthermore, the slats of the present invention can be formed utilizing one or more materials. For example, it may be desirably to coextrude the slats using a relatively rigid material for one portion and a more resilient material for one or more other portions.

Desirably, the slats, and their respective stops are formed as an integral unit and preferably from a thermoplastic, polymeric material, e.g., polyethylene, polypropylene or combinations thereof, which may be aesthetically colored to provide a pleasing appearance.

Figure 24:
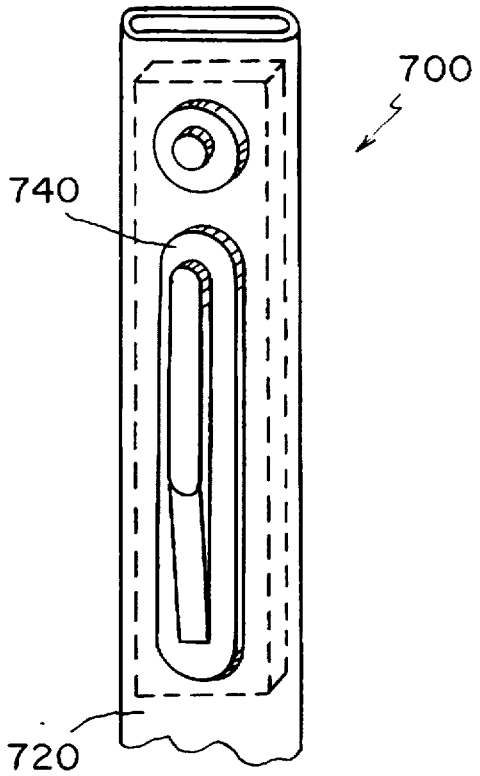
FIG. 24 is a perspective view of still another embodiment of the present invention for a fence slat which includes a hollow elongated body and an insertable locking member.
Figure 25:
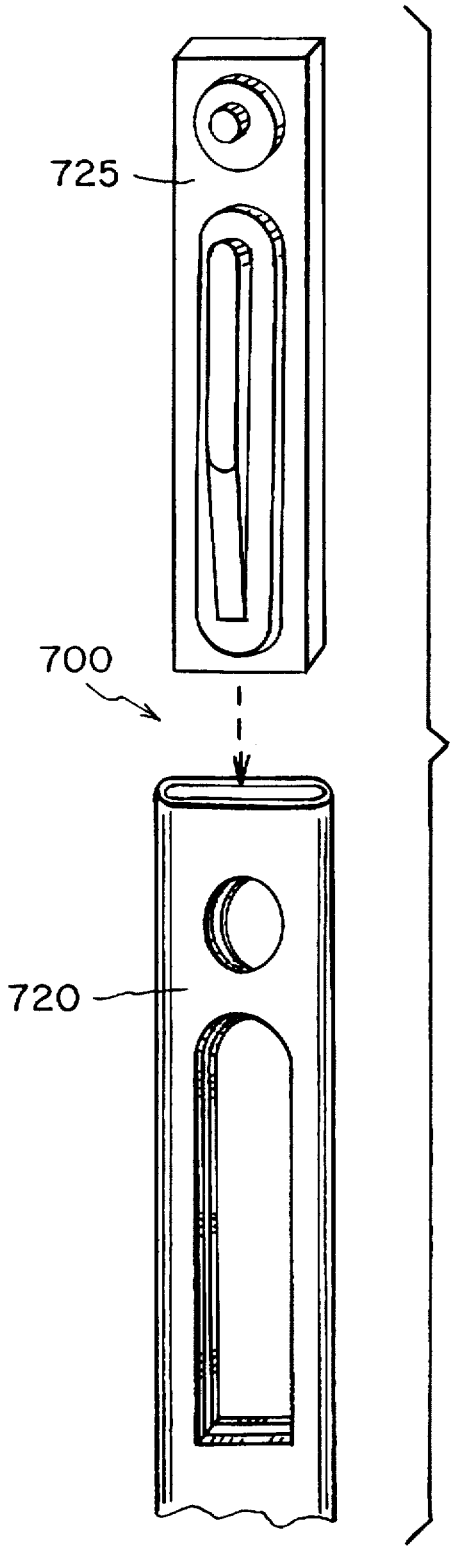
FIG. 25 is an exploded perspective view of the fence slat shown in FIG. 24.

FIGS. 24 and 25 illustrate a further embodiment of a fence slat according to the present invention. In this illustrated embodiment, a two-piece fence slat 700 comprises an outer hollow elongated body 720 and an insertable locking member 725 which when assembled (as shown in FIG. 24) provides a fence slat that is insertable in a channel of a chain link fence and once received therein is inhibited from being readily removed.

Figure 27:
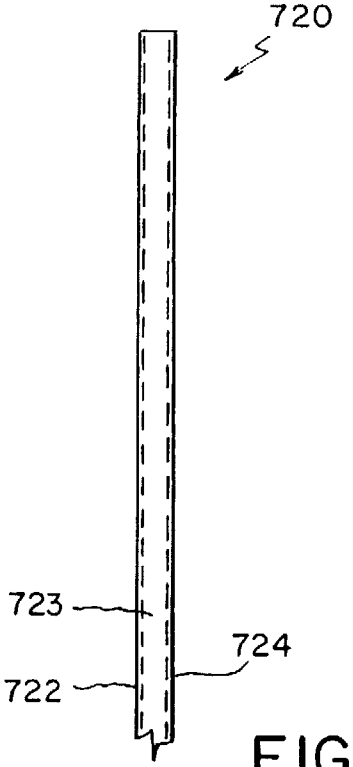
FIG. 26–28 are a front elevational view, a side elevational view, and an end view, respectively of the hollow elongated body shown in FIG. 24.
Figure 26:
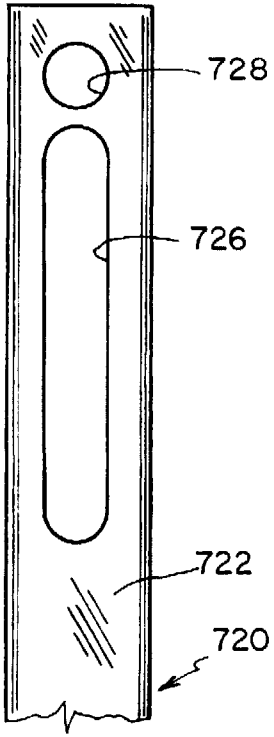
Figure 28:
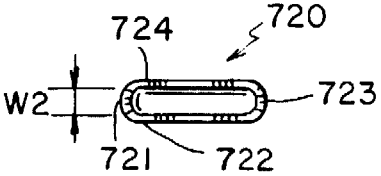

As shown in FIGS. 26–28, elongated body 720 comprises a front sidewall 722, a spaced-apart rear sidewall 724, and opposite connecting walls 721 and 723 which define a channel therebetween. Desirably, the elongated body 720 may be readily and inexpensively formed from a polymeric material, e.g. by extrusion. Illustrated front sidewall 722 and rear sidewall 724 each have a first oval-shaped aperture 726 and a circular-shaped aperture 728 extending therethrough. Apertures 726 and 728 are desirably longitudinally spaced from each other and aligned.

Figure 30:
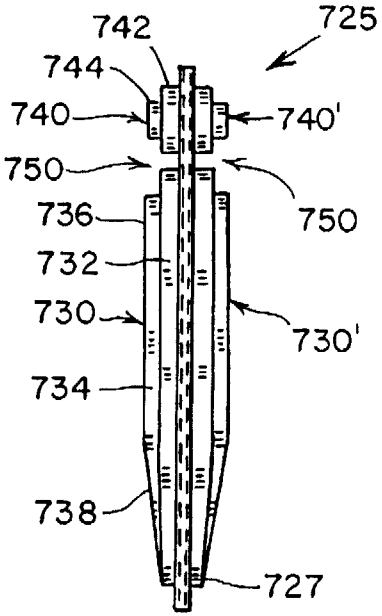
FIG. 29–31 are a front elevational view, a side elevational view, and an end view, respectively of the insertable locking member shown in FIG. 24.
Figure 29:
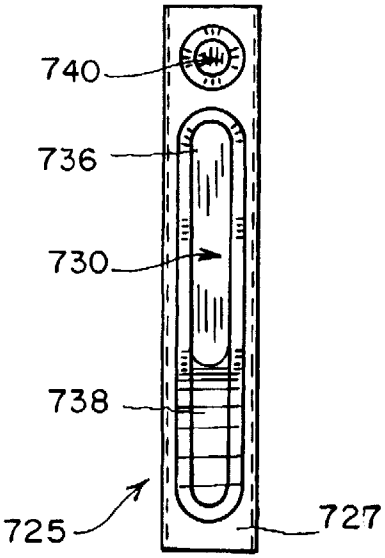
Figure 31:
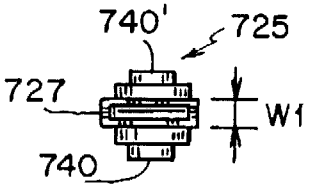

As shown in FIGS. 29–31, the illustrated insertable locking member 725 comprises a generally planar portion 727 having extending from one side thereof a first generally oval-shaped outwardly extending stop 730 and a second generally circular-shaped outwardly extending stop 740. Desirably, planar portion 727 has a width W1, as shown in FIG. 31, which is slightly less than the inside spacing W2 between sidewalls 722 and 724, as shown in FIG. 28. In addition, outwardly extending stops 730 and 740 are spaced from each other and define a passageway 750 therebetween to receive a portion of a link of a chain link fence.

In this illustrated embodiment, stop 730 comprises a base portion 732 upon which is disposed an outer portion 734. Desirably, stop 730 is elongated, disposed longitudinally along a surface of planar member 727, and comprises a generally flat surface portion 736 and a tapered surface portion 738. Tapered surface portion 738 readily allows insertable locking member 725 to be inserted into elongated body 720 and assembled therewith in a snap-fit manner. In addition, tapered surface portion 738 readily allows assembled slat 700 to be inserted into a channel of a chain link fence and to engage a link thereof in a snap-fit manner.

Illustrated stop 740 is advantageously spaced from stop 730 and comprises a generally circular base 742 and a circular tab 744. Desirably, passageway 750 has a depth sufficient to receive the full diameter of a link in a chain link fence. The sides of stops 730 and 740 provide an abutting surface which extends generally perpendicular to front sidewall 722 for abutting a link of a chain link fence.

While elongated body 720 is hollow to be economically fabricated, from the present description it will be appreciated to those skilled in the art that insertable locking member 725 increases the structural integrity and rigidity of the end portion of elongated body 720. While insertable locking member is desirably hollow, it is appreciated that insertable locking member can be, for example, solid or consist of multiple portions. The inserts of these embodiments of the present invention are preferably designed with sufficient resiliency to be inserted into a hollow body member, and when the stop is aligned with its corresponding aperture, the stop is preferably biased outwardly in order to urge the stop at least partially through the aperture. Therefore, from the present description, those skilled in the art will appreciate that a separate biasing member, such as a leaf spring, may also be employed to facilitate both assembly of the slat, as well as insertion into a fence. Such a biasing member can be formed of the same material as either the body member or the insert, or of different materials. It is also within the scope of the present invention to form one or more of the stops from a material which is different from the body member. It is also within the scope of the present invention to provide an insert which is folded in a manner wherein one portion on a first side of the fold will face the forward portion of the body member and another portion of the insert on the other side of the fold will face the rear portion of the body member. Such folding can provide the needed resiliency for allowing easy insertion of the insert into the body member while also providing sufficient outward bias and force to urge one or more stops through the aperture(s).

Desirably, fence slat 700 comprises a pair of stops 730' and 740' disposed on the opposite side of planar member 727 in alignment with respective stops 730 and 740 so that when assembled with elongated body 720 slat 700 is reversibly positionable in a channel of a chain link fence.

Preferably, elongated body 720 and insertable locking member 725 are formed from a thermoplastic, polymeric material, e.g., polyethylene, polypropylene or combinations thereof, and which may be aesthetically colored to provide a pleasing appearance.

Figure 6:
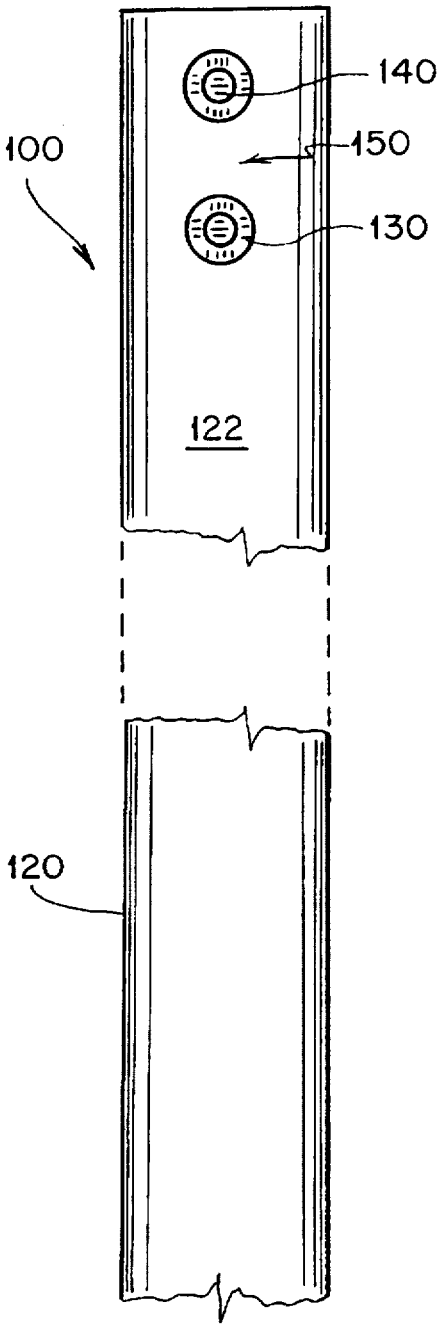
FIG. 6 is a front elevational view of the other fence slats shown in FIG. 1.
Figure 7:
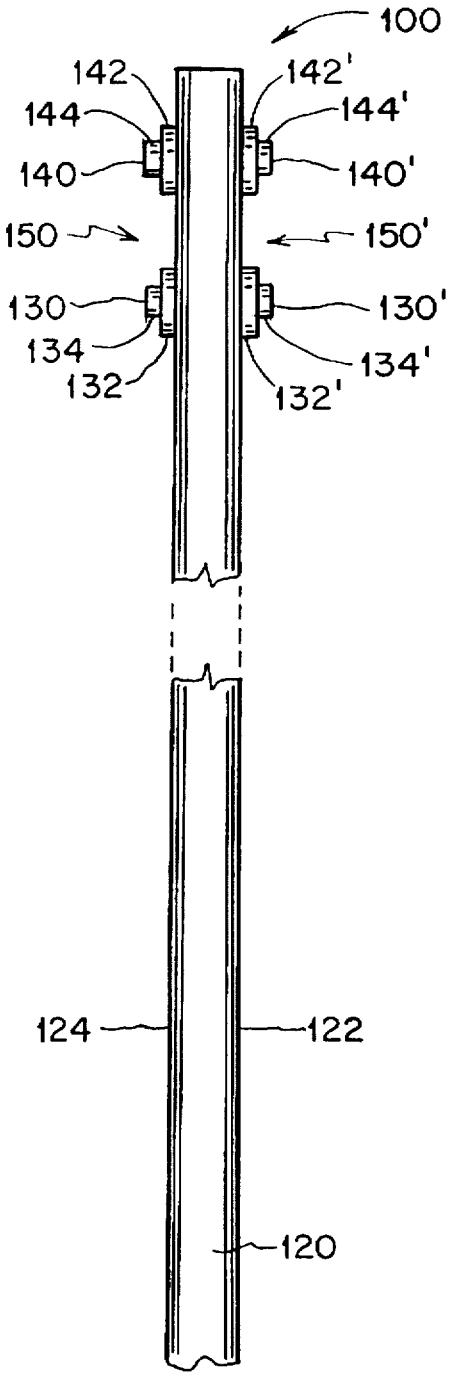
FIG. 7 is a side elevational view of the fence slat shown in FIG. 6.
Figure 8:
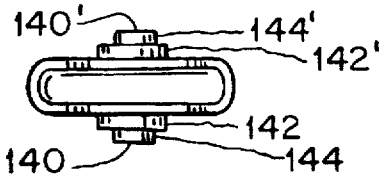
FIG. 8 is an end view of the fence slat shown in FIG. 6.

From the present description, it will be appreciated to those skilled in the art that a fence slat comprising an insertable locking member can be configured with a pair of spaced generally circular raised stops (e.g., as shown in FIGS. 6–8), a single stop on at least one side (e.g., as shown in FIGS. 9–11 and 12–14), at least one stop on each side which is not aligned (e.g., as shown in FIGS. 15–17 and FIGS. 21–23), and with wing portions (e.g., as shown in FIGS. 18–20). In addition, it will be appreciated that elongated body need only contain a single aperture in the front sidewall, while the insertable locking member provides two stops which extend through the single aperture in the front sidewall of the elongated body. Other configurations are also possible without departing from the scope of the present invention.

While the two-piece fence slat can be assembled prior to inserting into a channel of a chain link fence, from the present invention it will also be appreciated to those skilled in the art that the elongated body can be inserted into a channel of a chain link fence first, and then, the insertable locking member inserted into the elongated body to engage the elongated body and a link of a chain link fence in a snap-fit manner. While the illustrated embodiments provide inserts which are insertable from one end of the fence slat, it is also within the scope of the present invention to provide an insert which is inserted through an aperture, through which a stop will ultimately extend.

From the present description, those skilled in the art will appreciate that the embodiments disclosed herein comprises a separate insert may be formed using machinery which is less sophisticated than when one or more stops are integrally formed with a hollow body member.

What is claimed is:

1. A fence slat receivable in a channel formed by interwoven wires of a chain link fence, said fence slat comprising:

a substantially hollow elongated body comprising a front sidewall, said front sidewall comprising first and second front apertures extending therethrough; and an insertable locking member comprising first and second outwardly extending front stops, said insertable locking member insertable at least partially in said elongated body so that said first and second front stops extend through said first and second front apertures, respectively.

2. A fence slat according to claim 1 wherein said hollow elongated body comprises a rear side wall, said rear sidewall comprising at least one rear aperture extending therethrough.

3. A fence slat according to claim 2 wherein said insertable locking member comprises at least one outwardly extending rear stop extendable through said rear aperture.

4. A fence slat according to claim 3 wherein said insertable locking member comprises a plurality of rear stops.

5. A fence slat according to claim 4 wherein said front and rear stops are aligned.

6. A fence slat according to claim 4 wherein said front and rear stops are not aligned.

7. A fence slat according to claim 1 wherein said elongated body comprises a rear sidewall comprising first and second rear apertures, and said insertable locking member comprises outwardly extending first and second rear stops extendable through said first and second rear apertures, respectively.

8. A fence slat according to claim 7 wherein said first front stop and said first rear stop are aligned, and said second front stop and said second rear stop are aligned.

9. A fence slat according to claim 7 wherein said first front stop and said first rear stop are not aligned and said second front stop and said second rear stop are not aligned.

10. A fence slat according to claim 1 wherein at least one front stop comprises a generally tapered surface portion.

11. A fence slat according to claim 1 wherein at least one front stop comprises an abutting surface extending generally perpendicular to said front sidewall.

12. A fence slat according to claim 1 wherein at least one front stop is generally oval-shaped.

13. A fence slat according to claim 1 wherein at least one front stop is generally circular-shaped.

14. A fence slat according to claim 1 wherein said front stops form a passageway comprising a depth which is adapted to be substantially equal to the diameter of the wires of the chain link fence.

15. A fence slat according to claim 1 wherein said elongated body and said insertable locking member comprise polyethylene, polypropylene or combinations thereof.

16. A fence slat assembly comprising:

a plurality of interlocking chain links;

a substantially hollow elongated body comprising a front sidewall, said front sidewall comprising first and second front apertures extending therethrough; and an insertable locking member comprising first and second outwardly extending front stops, said insertable locking member insertable at least partially in said elongated body so that said first and second front stops extend through said first and second front apertures, respectively.

17. An assembly according to claim 16 wherein said elongated body comprises a rear sidewall comprising at least one rear aperture extending therethrough, and said insertable locking member comprises at least one rear stop extendable through said rear aperture.

18. An assembly according to claim 16 wherein said hollow elongated body comprises a rear sidewall comprising first and second rear apertures, and said insertable locking member comprising first and second outwardly extending rear stops extendable through said first and second rear apertures, respectively.

19. An assembly according to claim 18 wherein said first front stop and said first rear stop are aligned, and said second front stop and said second rear stop are aligned.

* * * * *